US005360161A

United States Patent [19]

Schaller et al.

[11] Patent Number: 5,360,161

[45] Date of Patent: Nov. 1, 1994

[54] APPARATUS FOR CUTTING PHOTOGRAPHIC PAPER

[75] Inventors: Wolfgang Schaller; Rolf Unger, both of Gera, Germany

[73] Assignee: Agfa - Gevaert AG, Leverkusen, Germany

[21] Appl. No.: 107,492

[22] Filed: Aug. 17, 1993

[30] Foreign Application Priority Data

Sep. 4, 1992 [DE] Germany ..... 4229518

[51] Int. Cl.[5] ..... B26D 1/14; B26D 1/16

[52] U.S. Cl. ..... 234/42; 234/46; 234/49; 83/408; 83/25

[58] Field of Search ..... 234/42, 46, 49, 130; 83/408, 255, 599, 598

[56] References Cited

U.S. PATENT DOCUMENTS

| | | | |
|---|---|---|---|
| 3,811,768 | 5/1974 | Zahn et al. | 83/408 X |
| 4,506,824 | 3/1985 | Bartz . | |
| 4,641,555 | 2/1987 | Johnson et al. | 83/408 X |
| 4,669,644 | 6/1987 | Nilsson | 83/408 X |
| 4,784,318 | 11/1988 | Bay | 234/46 X |

FOREIGN PATENT DOCUMENTS

| | | |
|---|---|---|
| 918609 | 9/1954 | Germany . |
| 2040779 | 9/1980 | United Kingdom . |

*Primary Examiner*—Rinaldi I. Rada
*Attorney, Agent, or Firm*—Karl F. Milde, Jr.

[57] ABSTRACT

Apparatus for cutting an advancing strip of photographic paper into prints of different size along and across the strip. The apparatus includes devices that cut perpendicular to the edges of the strip upstream of devices that cut parallel with the edges of the strip. Other devices secure the paper in position while it is being cut.

11 Claims, 4 Drawing Sheets

APPARATUS FOR CUTTING PHOTOGRAPHIC PAPER

BACKGROUND OF THE INVENTION

The present invention concerns apparatus for cutting photographic paper.

What are called "package prints" are often produced, in particular, in the field of portrait photography. A number of prints of different size are produced in a single exposure from a single negative on a single strip of paper 10 to 12" wide with several lenses. The different prints are distributed along and across the strip in accordance with size. Once the strip has been developed, the prints must be cut out separately.

The U.S. Pat. No. 4,506,824 discloses cutting apparatus for this purpose. The cuts are made with guillotines that enter a matrix of gaps in the surface supporting the strip. Since the knives that cut parallel with the edges of the strip must not be any longer than the strip edge parallel edges of the smallest print in the package, the strip edge parallel edges of each larger print must be cut in more than one step and will accordingly never be perfectly smooth and straight. However, since a portrait photographer's customers in particular demand high quality results, zigzag edges are not acceptable.

SUMMARY OF THE INVENTION

The principal object of the present invention is to provide photographic paper cutting apparatus of the aforesaid type that will cut the edges of each individual print smooth and straight.

This object, as well as other objects which will become apparent from the discussion that follows, are achieved, in accordance with the present invention, by apparatus for cutting an advancing strip of photographic paper which includes devices that cut perpendicular to the edges of the strip upstream of devices that cut parallel to the edges of the strip, as well as devices that secure the paper in position while it is being cut.

This apparatus ensures that the strip edge parallel cuts do not stop inside the strip, because the transverse cuts have already been made, once the corresponding point on the strip arrives at the position where the strip edge parallel cut is to be made. The strip edge parallel cuts are accordingly always made from one already cut strip edge perpendicular print edge to the next already cut strip edge perpendicular print edge. It is then be possible to make a continuous strip edge parallel cut with a guillotine or knife at least as long as the strip edge parallel edge of the largest prints.

One preferred embodiment of the present invention saves space by using rotating knives that can be engaged and disengaged as needed. Below the level of the paper are two parallel bars. When the rotating knife is engaged it rotates in the gap between the two bars. Since the rotating knife must precisely fit between the two bars to obtain a precise cut, the bars taper and create a wedge shaped gap to help guide the knife.

The photographic paper strip is cut perpendicular to its edge, in accordance with the present invention, with one knife that cuts all the way across it and with two other knives that cut part way across the strip. Although the knives that cut part way across are aligned, they can be separately engaged. All the edge-perpendicular knives are vertically guided by rails located beyond the edges of the strip and are inserted into gaps between pairs of bars below the strip. A projection from each knife also always enters the gap between the bars at a profile beyond the edges of the strip to help guide the cutting surface, which is slanted like the profile of a roof. To ensure that the ends of the cuts extending only part way across the paper strip will also be clean, the gap between the bars is terminated at position of the end of the cut by an intermediate web.

Both the devices that made the strip edge parallel cuts and those that make the strip edge perpendicular cuts are designed to remove narrow strips of waste. Although this feature does negligibly reduce the size of the prints, it ensures that any overlapping and blank areas in the form of white margins left on the paper due to poor alignment during the printing process will be separated from the images.

One of the bars that demarcate each gap accommodating the knives that make the strip edge perpendicular cuts can tilt toward and away from the other, and the two bars that demarcate each gap accommodating the rotating knives that make the strip edge parallel cut also move slightly. Since the upper edge of each moving bar is forced against the powered knife, the cutting tolerance will always be zero.

To keep the strip aligned while it is being cut parallel to its edges, it is accommodated by conveyor belts above and below it even before it is cut perpendicular to its edges. The paper is then advanced, while secured between the belts, through the devices that make the strip edge parallel cuts. The number of adjacent belts is the same as the highest number of prints across the strip. The belts are narrow enough to fit between the rotating knives that make the strip edge parallel cuts.

For a full understanding of the present invention, reference should now be made to the following detailed description of the preferred embodiment of the invention as illustrated in the accompanying drawings.

DESCRIPTION OF THE PREFERRED EMBODIMENT

Figure 1:
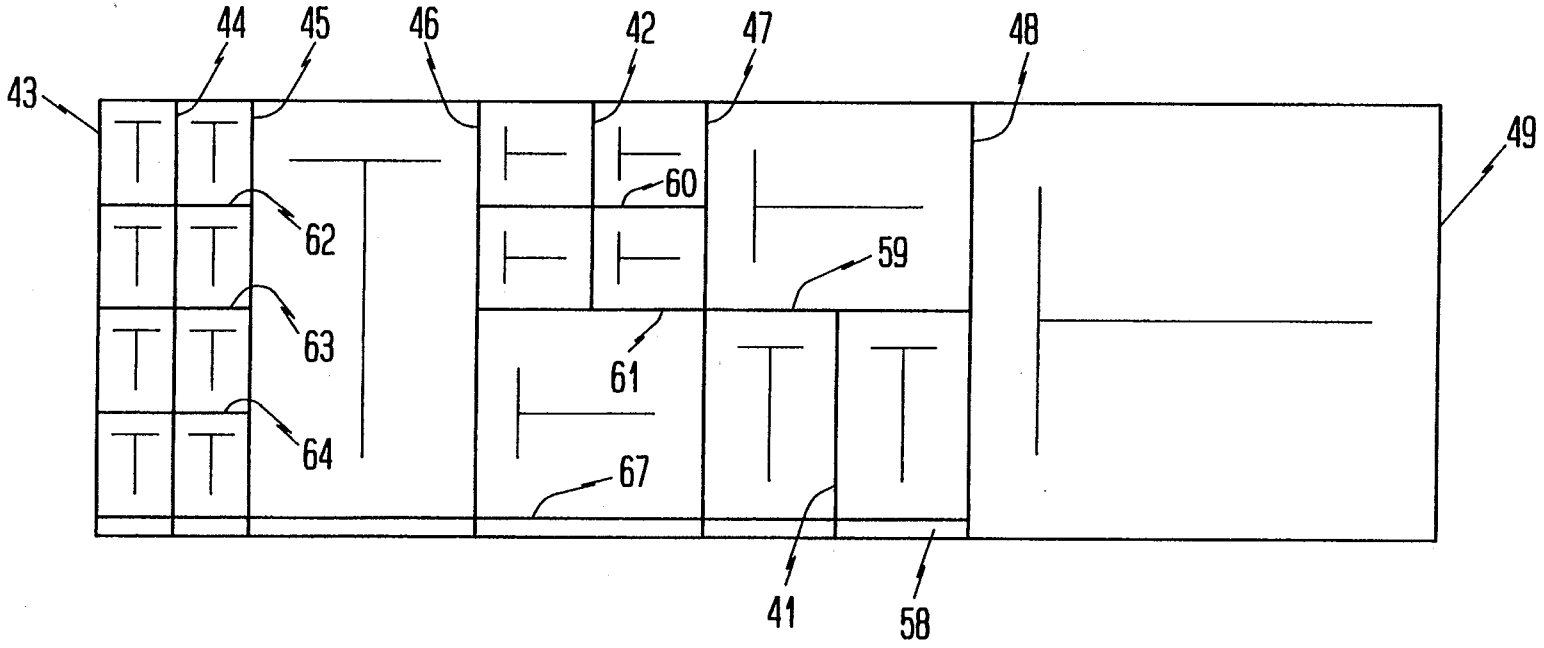
FIG. 1 illustrates a strip of photographic paper printed with "package prints" that must be cut out.
Figure 2:
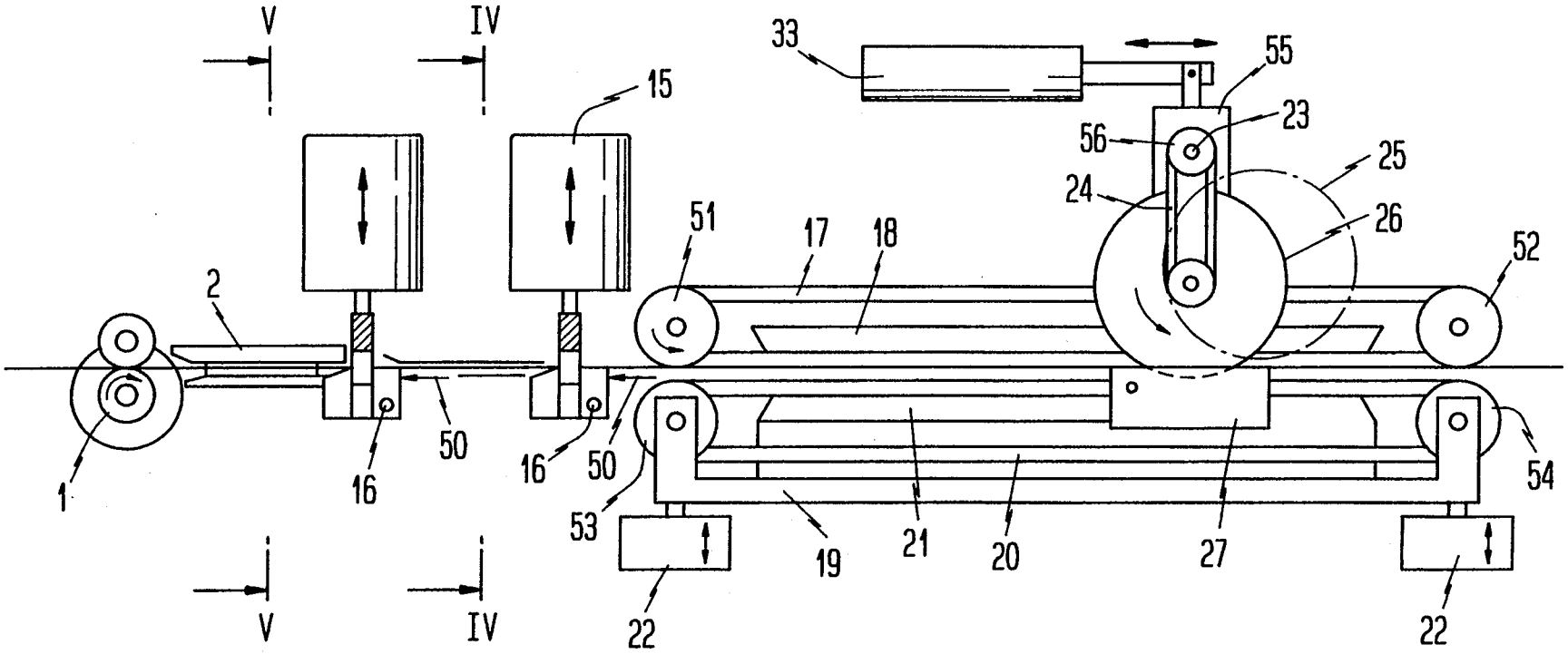
FIG. 2 is an elevational view, partly in section, through cutting apparatus in accordance with the invention.
Figure 3:
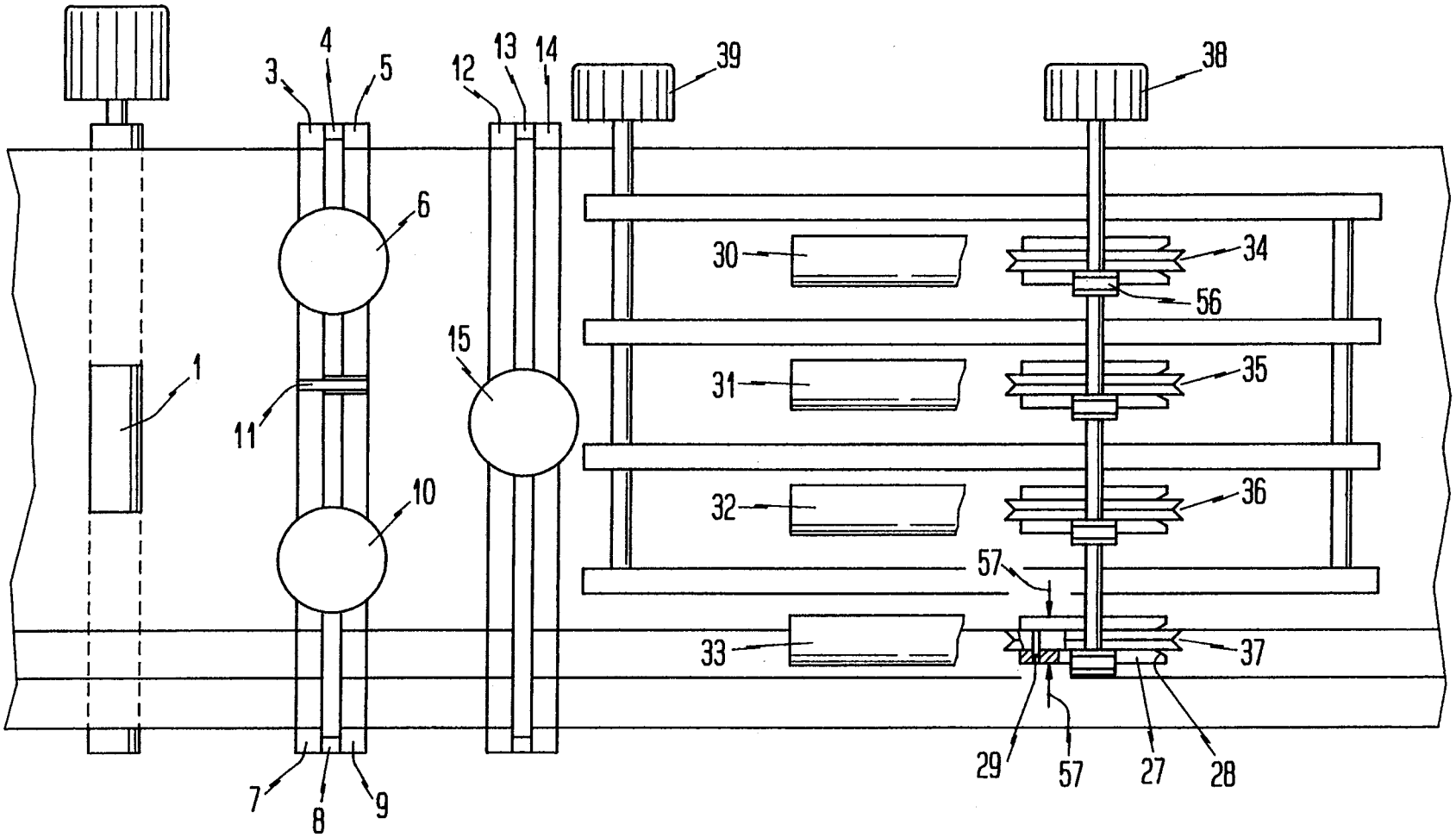
FIG. 3 is a top view of apparatus of FIG. 2 in accordance with the invention.
Figure 4:
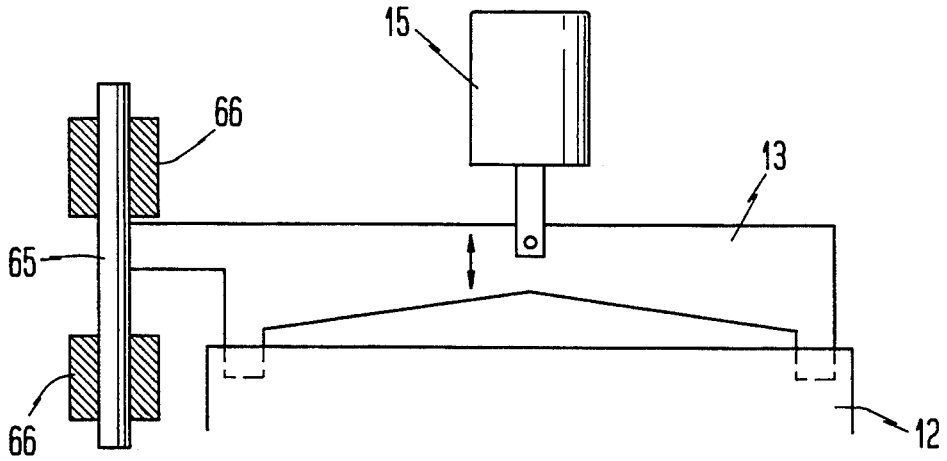
FIG. 4 is a section through the apparatus along the line IV—IV in FIG. 2.
Figure 5:
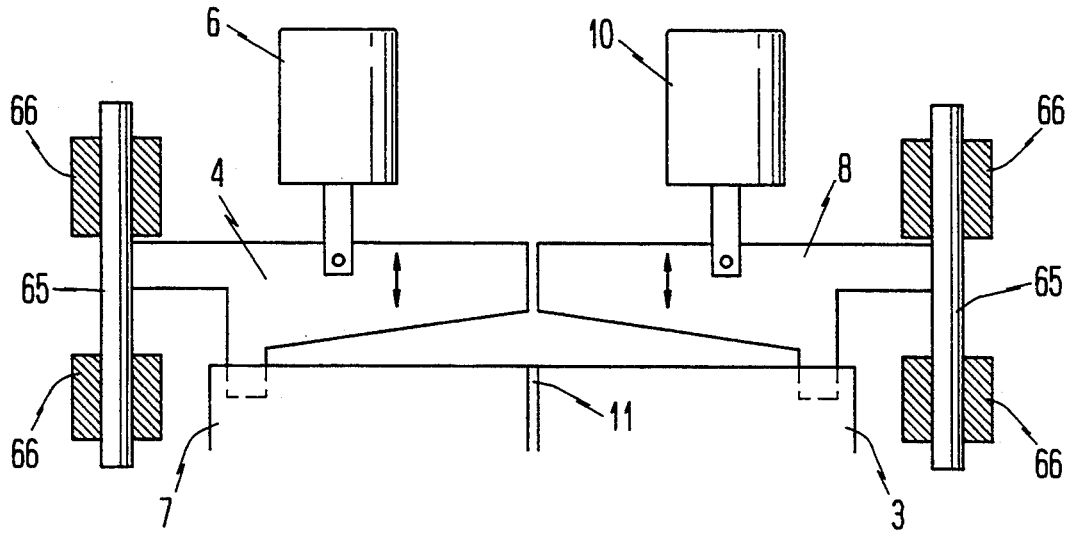
FIG. 5 is a section through the apparatus along the line V—V in FIG. 2.

Referring to FIGS. 1–5, a photographic paper strip (FIG. 1) is introduced into the apparatus by forwarding rollers 1 (FIGS. 2 and 3). The paper is prevented from curling by a curl preventer 2. The strip initially encounters two knives 4 and 8 (FIGS. 3 and 5) that make cuts 41 and 42 for example (FIG. 1) part way across the strip. These knives are attached to shafts 65 guided in bearings 66 (FIG. 5) on each side of the strip and are preferably but not necessarily aligned. Mounted below and extending across the strip of paper are straight bars 3, 5, 7, and 9. The knife 4 is inserted into a gap between bars 3 and 5. The bar 3 is stationary, and the bar 5 is tilted toward it about an axis 16 by an unillustrated spring to tighten the gap. The knife 8 similarly is inserted into a gap between bars 7 and 9. The bar 7 is also stationary, and the bar 9 is tilted toward it about another axis 16 by an unillustrated spring to tighten the gap. To ensure that the paper cut out of the strip by knives 4 and 8 is cut clean even in the middle of the print, the gap between the bars 3 and 5 and the gap between the bars 7 and 9 both terminate in a web 11 halfway across the strip. The knives 4 and 8 are activated by pneumatic devices 6 and 10, respectively.

The strip now encounters a knife 13 (FIGS. 3 and 4) that makes the strip edge perpendicular cuts 43, 44, 45, 46, 47, 48, and 49, for example, all the way across the strip (FIG. 1). The knife 13 is powered by a pneumatic device 15 and is inserted into a gap between bars 12 and 14. The bar 12 is stationary, and the bar 14 is tilted toward it about still another axis 16 by an unillustrated spring to tighten the gap. The force components are represented by arrows 50 in FIG. 2.

Once the strip has been cut edge-perpendicular, the pieces are secured in position, while being cut edge-parallel, by conveyor belts 17 and 20. Belts 17 travel around rollers 51 and 52 mounted above the paper and driven by a motor 39. The lower belts 20 travel about rollers 53 and 54 mounted on a moving component 19. Devices 22 can raise lower belts 20 against upper belts 17 to clamp the pieces of paper between them. Uniformity of pressure over the total length of the assembly is ensured by an upper shoe 18 and a lower shoe 21.

Rotating knives 34, 35, 36, and 37 are positioned between the conveyor belts. Each rotating knife is mounted on a holder 55 and can be pivoted in and out about a common axle 23. Each holder 55 is engaged by a piston and cylinder device 30, 31, 32, and 33. The axle 23 also constitutes a drive shaft powered by a motor 38. A pulley 56 is assigned to each rotating knife and rotates with the drive shaft 23.

Pulleys transmit the force of the shaft to the rotating knives through belts 24. Each knife 34 through 37 can be pivoted as necessary out of a disengagement position 25 represented by the broken lines in FIG. 2 and into an engagement position 26 represented by the solid lines. The rotating knives in the engagement position extend into a gap between two bars 27. Their entry is facilitated by sloping interception surfaces 28 on the bars. They are forced together in the direction indicated by arrows 57 by an unillustrated spring. The gap demarcated by spacers 29 while the rotating knives are in disengagement position 25 is slightly narrower than one of the knives.

The method of cutting the package prints illustrated in FIG. 1 will now be described. The already trimmed downstream edge 49 of the strip of paper is introduced into the apparatus of FIGS. 2–5 through the forwarding rollers 1 and belt rollers 51 and 53 until strip edge perpendicular print edge 48 is below the knife 13. The devices 22 are then activated and the strip is secured between conveyor belts 17 and 20. The knife 13 moves down and cuts print edge 48 all the way across the strip. The separated print advances on conveyor belts 17 and 20 without any of rotating knives being activated by the motor 39 and ends up in an unillustrated take-off tray. The strip continues until the strip edge perpendicular print edge 41 is below the knife 8. The knife cuts the print edge 41 part way across the strip and the device 2 is activated again until the strip edge perpendicular print edge 47 is below the knife 13. The knife 13 then cuts the print edge 47 all the way across the strip. The rotating knives 35 and 37 are now engaged by pneumatic devices 31, and 33 and the motor 38 turns on. The motor 39 also turns on and, as the paper travels through the strip edge parallel cutting devices, waste 58 is trimmed off and the strip edge parallel print edge 59 is cut.

The forwarding rollers 1 now advance the strip until the strip edge perpendicular print edge 42 is below the knife 4. The knife 4 cuts the edge 42 part way across the strip, which advances until the strip edge perpendicular print edge 47 is between the (in the meantime) separated conveyor belts 17 and 20 and the strip edge perpendicular print edge 46 is below the knife 13. The knife 13 cuts the edge 46 all the way across the strip, and the moving component 19 is raised to force the belts together again and secure the paper. The strip edge parallel print edges 60, 61 and 67 between strip edge perpendicular print edges 46 and 47 are then cut by the rotating knives 34, 35, and 37. Since the subsequent strip edge perpendicular print edge can simultaneously be advanced to below its associated knife while the strip edge parallel cuts are being made by the rotating knives, the parallel cuts need not take any extra time.

Since the procedures employed to produce the strip edge perpendicular print edges 44, 45 and the strip edge parallel print edges 62, 63, 64 are similar, they will not be described.

The apparatus in accordance with the present invention makes it possible to cut all the print edges, both strip edge parallel and strip edge perpendicular, in a single continuous procedure and so precisely that they cannot be distinguished from conventionally cut prints.

There has thus been shown and described a novel apparatus for cutting photographic paper which fulfills all the objects and advantages sought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention, which is to be limited only by the claims which follow.

What is claimed is:

1. In apparatus for cutting an advancing strip of photographic paper into prints of different size along and across the strip, said strip of paper having two opposite parallel edges, said apparatus comprising (a) first means for cutting the strip of paper in a direction perpendicular to the edges of the strip; (b) second means for cutting the strip of paper in a direction parallel with the edges of the strip; and (c) means for securing the strip of paper in position while it is being cut; the improvement wherein said first cutting means is arranged upstream of said second cutting means in the direction of the advancing strip, wherein said first cutting means include means for making two adjacent parallel cuts substantially simultaneously in said perpendicular direction and wherein said second cutting means include means for making two adjacent parallel cuts substantially simultaneously in said parallel direction, thereby to cut a narrow strip of waste from said strip of paper.

2. The apparatus as in claim 1, wherein said first cutting means comprise a first knife that cuts all the way across the strip and a second knife that cuts part way across the strip.

3. The apparatus as in claim 2, wherein said first cutting means further comprises a third knife that cuts part way across the strip, said second and third knives being arranged perpendicular to the edges of the strip and positioned to cut part way across the strip from its opposite edges with said second knife cutting from one edge and said third knife from the other.

4. The apparatus defined in claim 3, wherein said second and third knives each have two ends and are arranged on a common line, with their adjacent ends in facing relationship.

5. The apparatus defined in claim 4, further comprising means for guiding said second and third knives from a position beyond the edges of the strip and further comprising two cutting bars forming a gap for insertion of said second and third knives, thereby maintaining said adjacent ends in facing relationship.

6. The apparatus defined in claim 5, wherein said gap between the bars contains a web extending parallel to the edges of the strip between the adjacent ends of said second and third knives.

7. The apparatus defined in claim 6, wherein one of said cutting bars is tiltably mounted and biased against said rotating knives when inserted in said gap.

8. The apparatus defined in claim 2, further comprising means for guiding said first and second knives, respectively, from a position beyond the edges of the strip and further comprising two cutting bars forming a gap for insertion of said first and second knives, with at least one cutting bar being tiltable toward the inserted knife.

9. The apparatus defined in claim 1, further comprising two cutting bars forming a gap for insertion of said second cutting means and wherein the second cutting means comprise rotating knives and means for moving said rotating knives from a disengagement position into an engagement position extending into said gap between said cutting bars.

10. The apparatus defined in claim 9, wherein said gap between said cutting bars is wedge shaped.

11. The apparatus defined in claim 1, wherein said securing means comprise belts above and below the strip of paper and compression shoe means for forcing the belts together and accordingly against the paper at least in the vicinity of the rotating knives.

* * * * *